US005577941A

United States Patent [19]

Chartier

[11] Patent Number: 5,577,941

[45] Date of Patent: Nov. 26, 1996

[54] MARINE JET DRIVE WEED GRATE

[75] Inventor: Brian J. Chartier, Fond du Lac, Wis.

[73] Assignee: Brunswick Corporation, Lake Forest, Ill.

[21] Appl. No.: 516,436

[22] Filed: Aug. 17, 1995

[51] Int. Cl.[6] ..... B63H 11/01

[52] U.S. Cl. ..... 440/46; 440/38

[58] Field of Search ..... 440/46, 47, 38; 60/221, 222; 114/270; 244/53 B

[56] References Cited

U.S. PATENT DOCUMENTS 3,147,733 9/1964 Engel ..... 440/46

3,446,177 5/1969 Thornburg et al. ..... 440/46

5,468,165 11/1995 Weber et al. ..... 440/46

OTHER PUBLICATIONS

Mercury Marine Service Manual 90–824724, 1993, pp. 4A–1 through 4A–35.

*Primary Examiner*—Edwin L. Swinehart

*Attorney, Agent, or Firm*—Andrus, Sceales, Starke & Sawall

[57] ABSTRACT

A marine jet drive weed grate (50) has a plurality of cantilever tines (58–63) extending rearwardly along the water intake (32) and have suspended aft end tips (64–69) spaced from the aft end (36) of the water intake such that weeds and debris may slide rearwardly along and then off of the cantilever tines without clogging.

16 Claims, 5 Drawing Sheets

FIG. 1
PRIOR ART
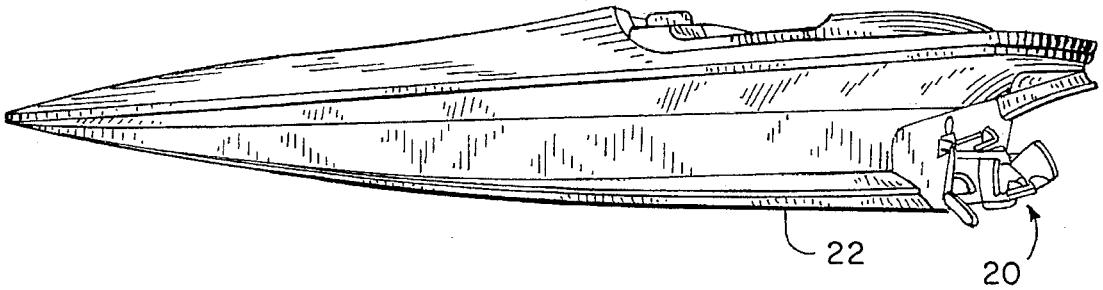
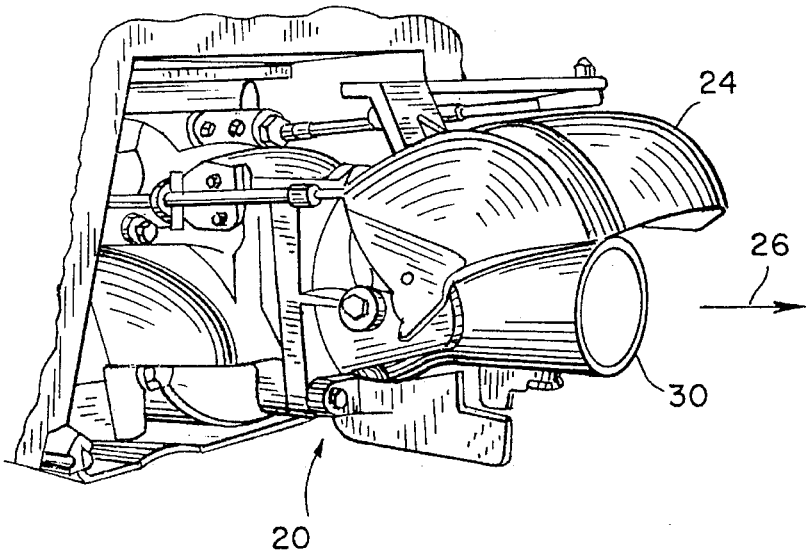
FIG. 2
PRIOR ART
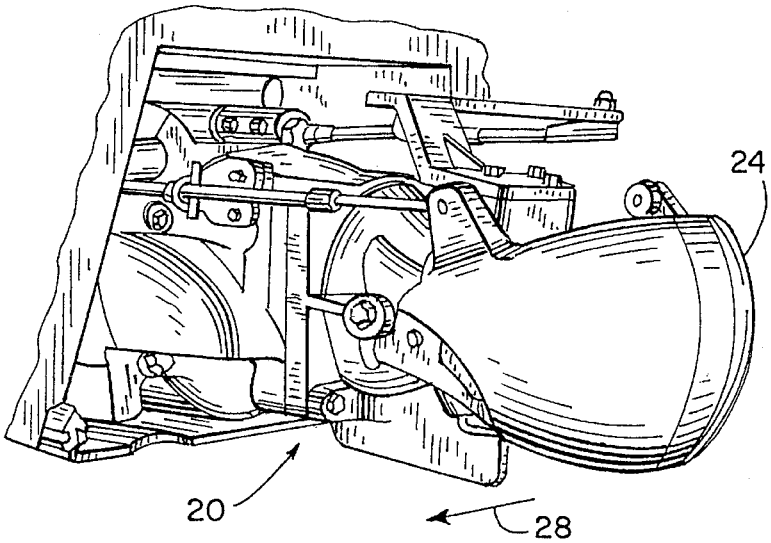
FIG. 3
PRIOR ART FIG. 4
PRIOR ART
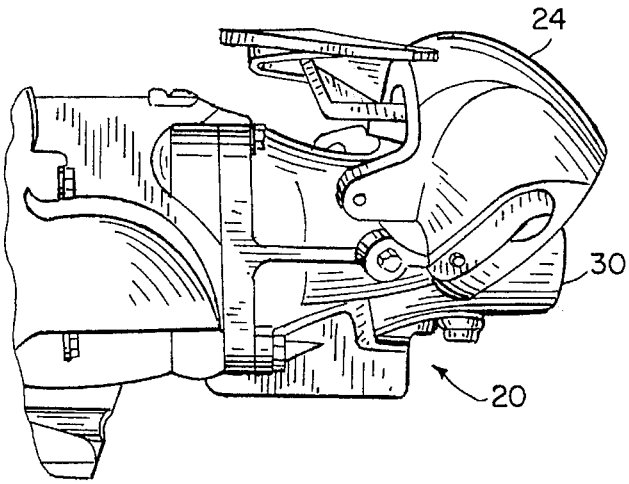
FIG. 5
PRIOR ART
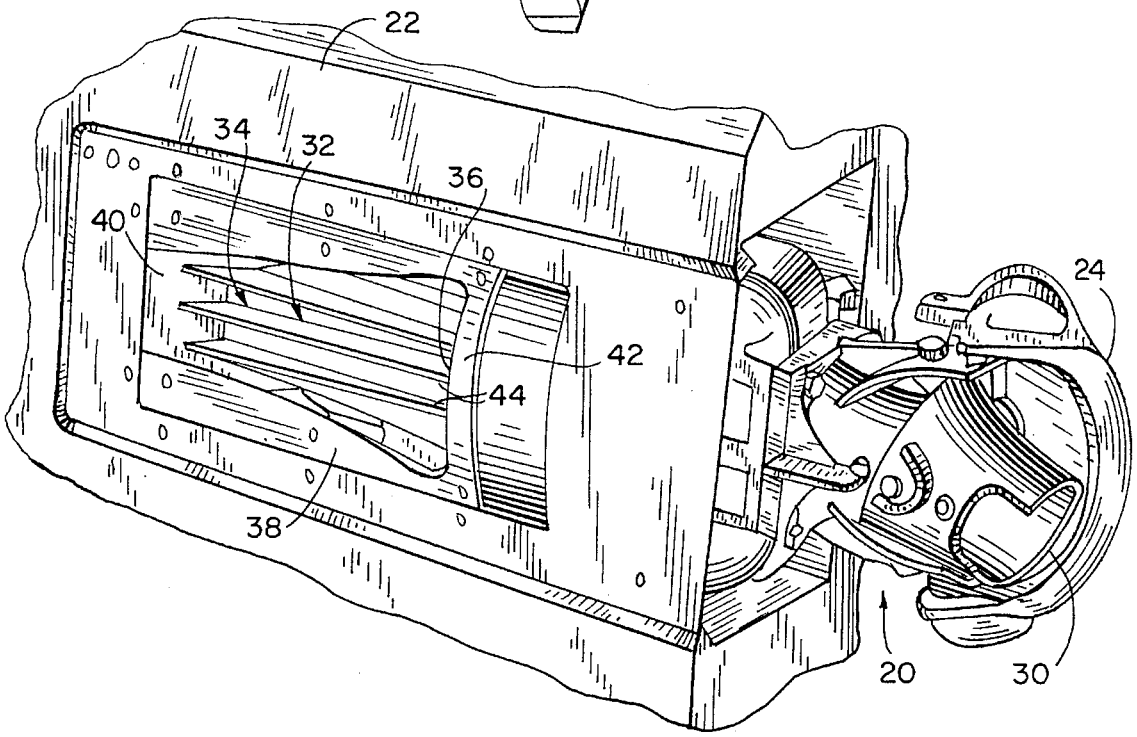
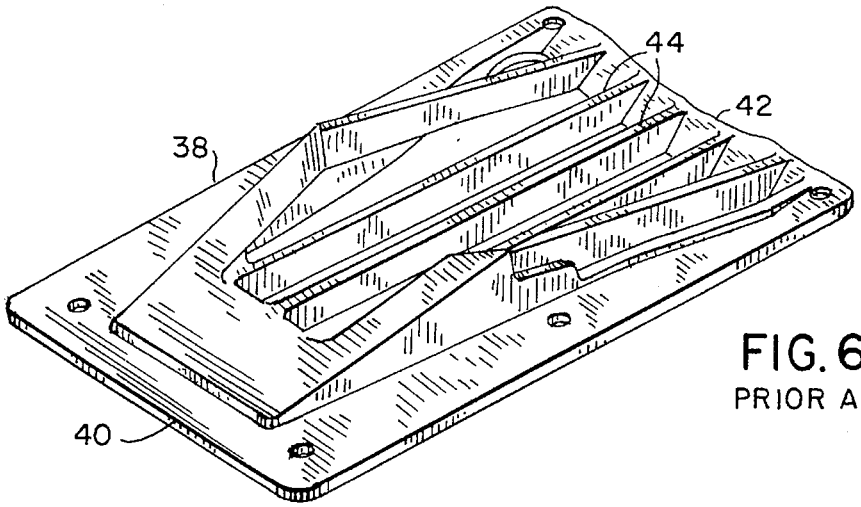
FIG. 6
PRIOR ART

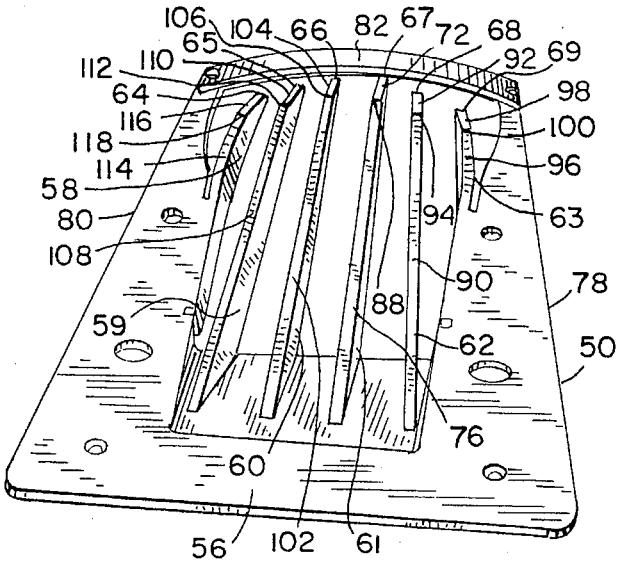
FIG. 10
FIG. 11
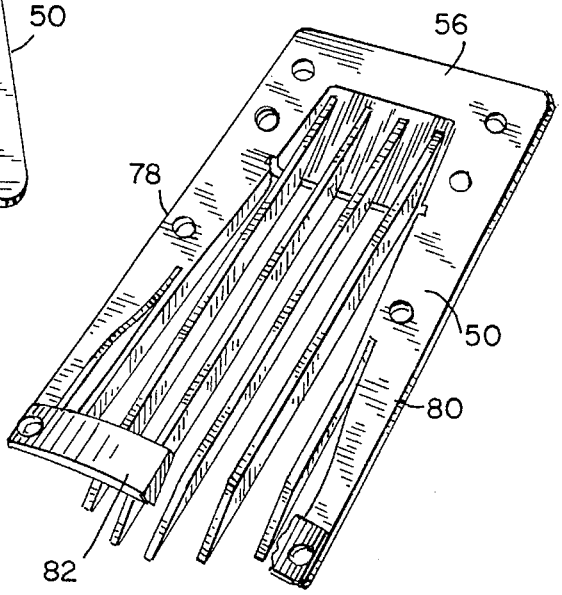
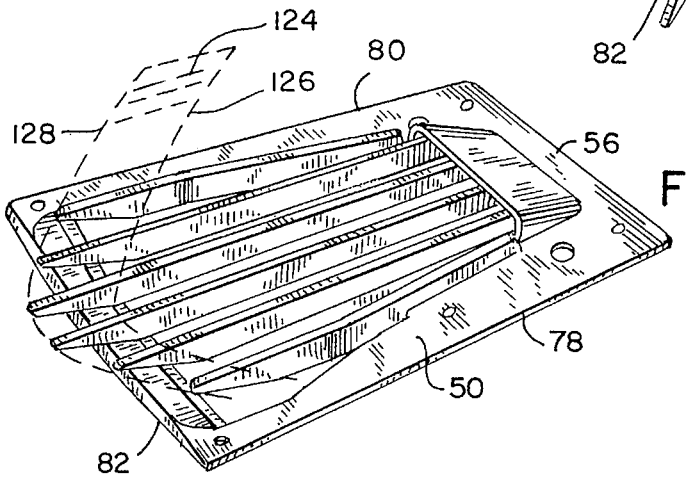
FIG. 13
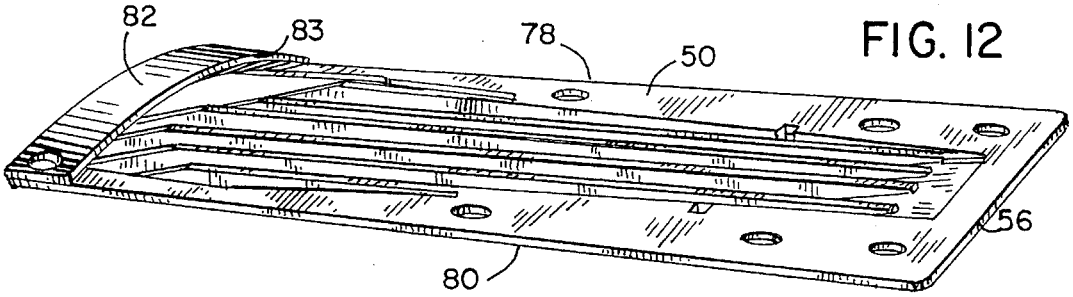
FIG. 12

MARINE JET DRIVE WEED GRATE

BACKGROUND AND SUMMARY

The invention relates to marine jet drives, and more particularly to weed grates therefor.

Marine jet drive intake grates are known in the prior art. The intake grate covers the water intake of the jet drive, and has forward and aft ends with tines extending longitudinally therebetween. Water is admitted upwardly and rearwardly through the grate into the water intake of the jet drive. The grate may become clogged due to weeds and debris wrapping around the tines of the grate and slide rearwardly along the tines and become stuck where the tines connect to the aft end of the grate. When the weeds build up, they block water flow into the water intake of the jet drive.

The present invention addresses and solves the noted clogging problem. Weeds and debris are allowed to slide off the tines at the aft end of the grate while the jet drive is operating. The anti-clogging feature is automatic, and no extra mechanism is needed for de-clogging. The structure retrofits existing jet drives, and does not protrude below the rest of the jet drive.

BRIEF DESCRIPTION OF THE DRAWINGS

Prior Art

FIG. 1 is a perspective view of a marine jet drive installed on a boat, as known in the prior art.

FIG. 2 is an enlarged view showing the jet drive of FIG. 1, and illustrates forward drive.

FIG. 3 is like FIG. 2 and illustrates reverse drive.

FIG. 4 is like FIGS. 2 and 3, and illustrates neutral.

FIG. 5 is an isometric view from below of the jet drive of FIG. 2.

FIG. 6 is an isometric view from above of the intake grate of FIG. 5 disassembled from the jet drive, as known in the prior art.

Present Invention

Figure 7:
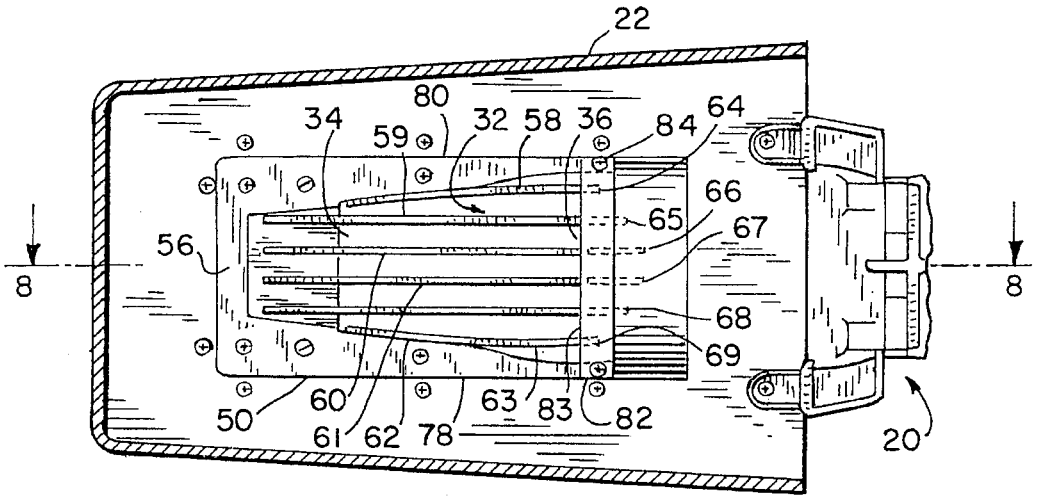

FIG. 7 is a bottom view of a jet drive with a weed grate in accordance with the invention.

Figure 8:
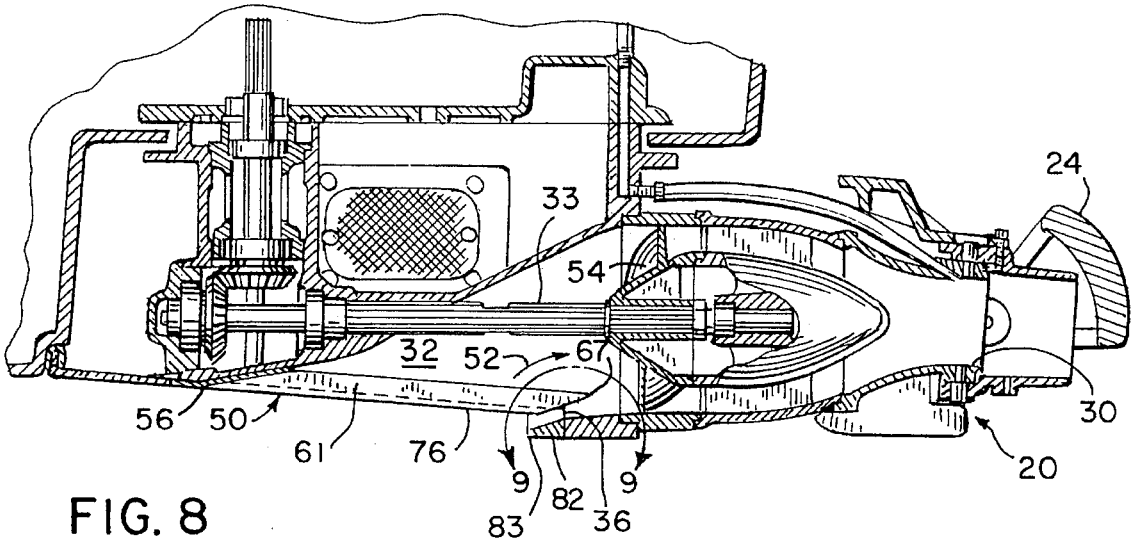

FIG. 8 is a sectional view taken along line 8—8 of FIG. 7.

Figure 9:
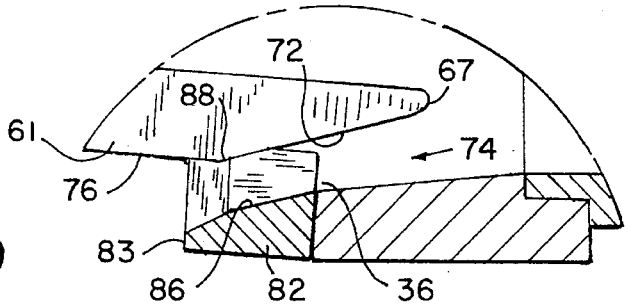

FIG. 9 is an enlarged view of section 9—9 of FIG. 8.

FIG. 10 is an isometric view of the weed grate of FIG. 7.

FIG. 11 is a further isometric view, partially cut away, of the weed grate of FIG. 7.

FIG. 12 is a further isometric view of the weed grate of FIG. 7.

FIG. 13 is a further isometric view of the weed grate of FIG. 7.

Figure 14:
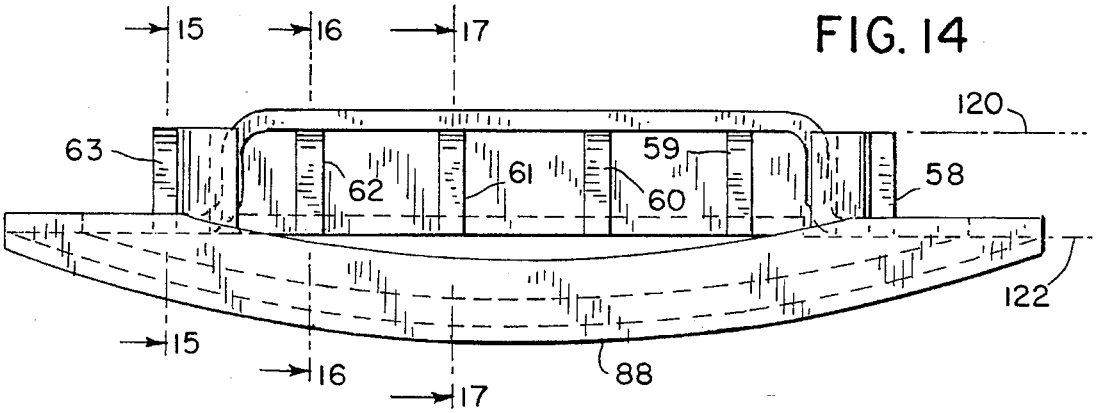

FIG. 14 is an end view of the weed grate of FIG. 7.

Figure 15:
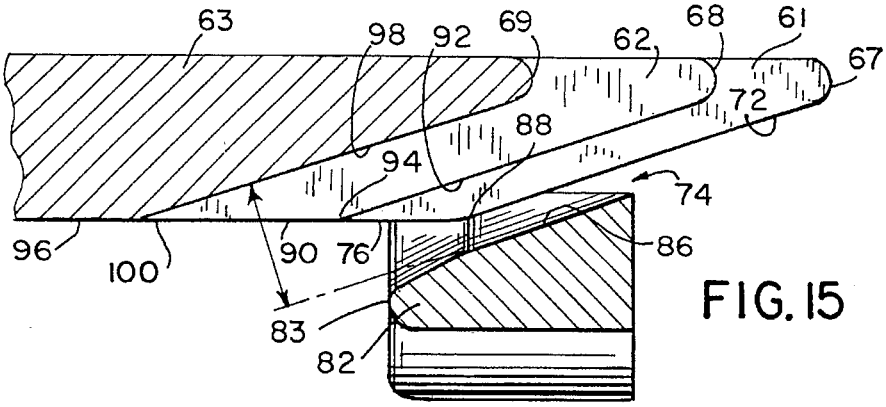

FIG. 15 is a sectional view taken along line 15—15 of FIG. 14.

Figure 16:
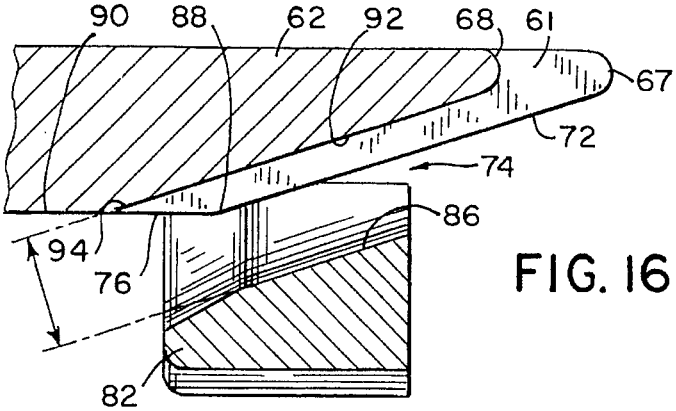

FIG. 16 is a sectional view taken along line 16—16 of FIG. 14.

Figure 17:
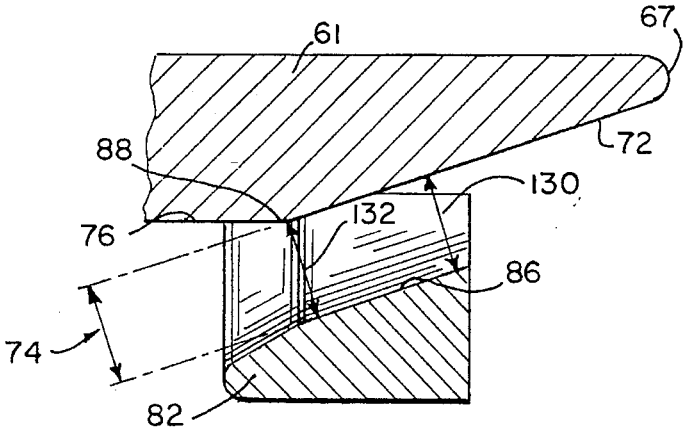

FIG. 17 is a sectional view taken along line 17—17 of FIG. 14.

DETAILED DESCRIPTION

Prior Art

FIG. 1 shows a marine jet drive 20 mounted to a boat 22, as known in the prior art, and for which further reference may be had to Mercury Marine Service Manual 90-824724, 1993, pages 4A-1 through 4A-35. The jet drive operates by drawing water into the jet pump housing, as shown in FIG. 8 at arrow 52 in water intake 32. The water is drawn in by high speed impeller 54 and propelled rearwardly through thrust nozzle 30. FIG. 2 shows gate 24 in an upward position such that the water thrust is in the direction shown at arrow 26, and the boat moves in the forward direction, i.e. leftwardly in FIG. 2. For the reverse direction of boat motion, gate 24 is moved downwardly, FIG. 3, such that water thrust is in the direction shown at arrow 28, and the boat moves in the opposite direction, i.e. rightwardly in FIG. 3. For the neutral position, gate 24 is moved partially downwardly, FIG. 4, to cover a portion of thrust nozzle 30, to balance the forward and reverse water thrust.

The jet drive has a water intake 32, FIG. 5, on the bottom of the boat. The water intake has forward and aft ends 34 and 36 and admits water upwardly and rearwardly therein. Intake grate 38 is provided by a plate mounted to the water intake and having forward and aft ends 40 and 42 with a plurality of tines 44 extending therebetween. Weeds and debris slide rearwardly along tines 44 and may become stuck where the tines meet aft end 42 of the intake grate.

Present Invention

In the present invention, FIGS. 7–17, a weed grate 50 is provided for water intake 32 of marine jet drive 20. Water intake 32 has forward and aft ends 34 and 36 and admits water upwardly and rearwardly therein as shown at arrow 52 in FIG. 8. The water is propelled rearwardly through thrust nozzle 30 by high speed impeller 54, all as is known in the prior art.

Grate 50 is provided by a plate mounted to water intake 32 and having a forward end 56 with a plurality of cantilever tines 58–63 extending rearwardly therefrom toward aft end 36 of water intake 32. The cantilever tines have respective suspended aft end tips 64–69 spaced from aft end 36 of the water intake such that weeds and debris may slide rearwardly along and then off of the cantilever tines at their aft end tips without clogging at the aft end of the water intake, FIGS. 8 and 9.

The cantilever tines have aft undersurfaces tapered upwardly and rearwardly to the aft end tips, for example as shown at cantilever tine 61, FIG. 9, having aft undersurface 72 tapered upwardly and rearwardly to aft end tip 67. The tapered aft undersurfaces of the cantilever tines extend along a taper spaced from aft end 36 of water intake 32 by a gap 74 which extends upwardly and rearwardly. The cantilever tines have main undersurfaces extending rearwardly toward the aft end of the water intake, for example as shown at main undersurface 76 of tine 61. The tapered aft undersurfaces of the cantilever tines extend upwardly and rearwardly from the main undersurfaces and above aft end 36 of the water intake, for example as shown at tapered undersurface 72 extending upwardly and rearwardly from main undersurface 76.

The weed grate plate has right and left sides 78 and 80 extending rearwardly from forward end 56 of the plate. Right and left sides 78 and 80 are laterally outward of cantilever tines 58–63. Cantilever tines 59–62 are mounted to forward end 56 of the plate, preferably by welding, and extend rearwardly therefrom. Right cantilever tine 63 is mounted to right side 78 of the plate, preferably by welding, and extends rearwardly therefrom. Left cantilever tine 58 is mounted to left side 80 of the plate, preferably by welding, and extends rearwardly therefrom. Weed grate plate 50 has an aft end 82 at aft end 36 of water intake 32 and extends laterally between right and left sides 78 and 80 of the weed grate plate and is mounted thereto, preferably by welding. The weed grate plate is mounted to the drive by bolts such as 84.

The suspended aft end tips 64–69 of tines 58–63 are spaced from aft end 82 of the plate by gap 74 extending into the water intake. Aft end 82 of the plate has an uppersurface 86, FIG. 9, tapered upwardly and rearwardly. The cantilever tines have aft undersurfaces, such as 72, FIG. 9, tapered upwardly and rearwardly and facing tapered upper surface 86 across gap 74. Aft end 82 of the weed grate plate is curved downwardly, FIGS. 14, 10 and 12, along an arc below the cantilever tines 58–63.

Cantilever tine 61 has main undersurface 76 extending rearwardly toward aft end 82 of the plate, and a tapered aft undersurface 72 meeting main undersurface 76 at junction 88, FIGS. 9 and 10, and extending upwardly and rearwardly therefrom. Cantilever tine 62 is laterally outward of cantilever tine 61 and has a main undersurface 90 extending rearwardly toward aft end 82 and has a tapered aft undersurface 92 meeting main undersurface 90 at a junction 94 and extending upwardly and rearwardly therefrom. Cantilever tine 63 is laterally outward of cantilever tine 62 and has a main undersurface 96 extending rearwardly toward aft end 82 and has a tapered aft undersurface 98 meeting main undersurface 96 at a junction 100 and extending upwardly and rearwardly therefrom. Cantilever tine 60 has a main undersurface 102 extending rearwardly toward aft end 82 and has a tapered aft undersurface 104 meeting main undersurface 102 at a junction 106 and extending upwardly and rearwardly therefrom. Cantilever tine 59 is laterally outward of cantilever tine 60 and has a main undersurface 108 extending rearwardly toward aft end 82 and has a tapered aft undersurface 110 meeting main undersurface 108 at a junction 112 and extending upwardly and rearwardly therefrom. Cantilever tine 58 is laterally outward of cantilever tine 59 and has a main undersurface 114 extending rearwardly toward aft end 82 and has a tapered aft undersurface 116 meeting main undersurface 114 at a junction 118 and extending upwardly and rearwardly therefrom. Junction 88 is aft of junction 94. Junction 94 is aft of junction 100. Junction 106 is aft of junction 112. Junction 112 is aft of junction 118.

Tapered aft undersurface 116 extends upwardly and rearwardly to aft end tip 64. Tapered aft undersurface 110 extends upwardly and rearwardly to aft end tip 65. Tapered aft undersurface 104 extends upwardly and rearwardly to aft end tip 66. Tapered aft undersurface 72 extends upwardly and rearwardly to aft end tip 67. Tapered aft undersurface 92 extends upwardly and rearwardly to aft end tip 68. Tapered aft undersurface 98 extends upwardly and rearwardly to aft end tip 69. Aft end tip 67 is aft of aft end tip 68. Aft end tip 68 is aft of aft end tip 69. Aft end tip 66 is aft of aft end tip 65. Aft end tip 65 is aft of aft end tip 64. Aft end tips 65–68, FIG. 7, are spaced above and aft of aft end 82 of the weed grate plate. Aft end tips 64 and 69 are spaced above aft end 82.

Aft end tips 64–69 are substantially coplanar in a horizontal plane 120, FIG. 14. Junctions 118, 112, 106, 88, 94,100 are substantially coplanar in a second horizontal plane 122 spaced below the first noted horizontal plane 120 by the height of the cantilever tines. Tapered aft undersurfaces 116, 110, 104, 72, 92, 98 are located progressively further forward from central tines to laterally outward tines such that the tapered undersurfaces lie in a curved arcuate surface 124, FIG. 13, extending upwardly and rearwardly into the water intake. Planes 120 and 122 are parallel. Curved arcuate surface 124 extends from plane 122 upwardly and rearwardly to plane 120. Curved surface 124 intersects horizontal plane 122 along an arc 126, and intersects horizontal plane 120 along an arc 128. Arcs 126 and 128 are parallel.

The taper of undersurface 72, FIG. 17, extends rearwardly and upwardly at a greater angle than, and is not parallel to, the taper of upper surface 86, such that the gap between such surfaces increases aft. This is illustrated in FIG. 17 where dimension 130 is greater than dimension 132. This ensures that any object that gets past the gap 74 at point 132 will pass point 130 without wedging itself. The relationship between upper surface 86 and the remaining aft undersurfaces 116, 110, 104, 92, 98 of the tines is similar, such that the height of gap 74 increases as it extends rearwardly and upwardly.

Each of tines 58, 59, 60, 61, 62, 63 has sufficient fore-to-aft length to extend aft beyond leading edge 83 of aft end 82, to prevent weeds from entering intake 32 and wrapping around impeller shaft 33. It is preferred that the central tines such as 60, 61 extend farther aft than outer tines such as 58, 63, along arc 128, to further protect shaft 33.

It is recognized that various equivalents, alternatives and modifications are possible within the scope of the appended claims.

I claim:

1. A marine jet drive weed grate for the water intake of a jet drive, said water intake having forward and aft ends and admitting water upwardly and rearwardly therein, said grate comprising:

a plate adapted to be mounted to said water intake and having a plurality of cantilever tines extending rearwardly toward said aft end of said water intake;

said cantilever tines having suspended aft end tips spaced from said aft end of said water intake such that weeds and debris may slide rearwardly along and then off of said cantilever tines at said aft end tips without clogging at said aft end of said water intake;

said cantilever tines having aft undersurfaces tapered upwardly and rearwardly to said aft end tips; and said tapered aft undersurfaces of said cantilever tines are spaced above said aft end of said water intake by a gap which extends upwardly and rearwardly.

2. The invention according to claim 1 wherein:

said cantilever tines have main undersurfaces extending rearwardly toward said aft end of said water intake; and said tapered aft undersurfaces of said cantilever tines extend upwardly and rearwardly from said main undersurfaces and above said aft end of said water intake.

3. The invention according to claim 2 wherein some of said tapered aft undersurfaces of said tines have forward lower ends meeting said main undersurfaces at junctions spaced forwardly of said aft end of said water intake.

4. The invention according to claim 1 wherein said plate has a forward end and right and left sides extending rearwardly from said forward end, said right and left sides being laterally outward of said cantilever tines.

5. The invention according to claim wherein said plurality of cantilever tines include:

a plurality of central cantilever tines mounted to said forward end of said plate and extending rearwardly therefrom;

a right cantilever tine mounted to said right side of said plate and extending rearwardly therefrom;

a left cantilever tine mounted to said left side of said plate and extending rearwardly therefrom.

6. The invention according to claim 4 wherein:

said plate has an aft end at said aft end of said water intake and extending laterally between said right and left sides of said plate; and said suspended aft end tips of said tines are spaced above said aft end of said plate by a gap extending into said water intake.

7. The invention according to claim 1 wherein said aft undersurfaces being located progressively further forward from central tines to laterally outward tines such that the tapered undersurfaces define a single curved arcuate surface extending upwardly and rearwardly into said water intake.

8. The invention according to claim 1 wherein the height of said gap increases as said gap extends upwardly and rearwardly.

9. A marine jet drive weed grate for the water intake of a jet drive, said water intake having forward and aft ends and admitting water upwardly and rearwardly therein, said grate comprising:

a plate adapted to be mounted to said water intake and having a plurality of cantilevered tines extending rearwardly toward said aft end of said water intake;

said plate having a forward end and right and left sides extending rearwardly from said forward end, said right and left sides being laterally outward of said cantilevered tines;

said plate having an aft end at said aft end of said water intake and extending laterally between said right and left sides of said plate;

said aft end of said plate having an uppersurface tapered upwardly and rearwardly;

said cantilevered tines have aft undersurfaces tapered upwardly and rearwardly and facing said tapered uppersurface of said aft end of said plate across a gap extending into said water intake; and said cantilever tines having suspended aft end tips spaced above said aft end of said plate by said gap such that weeds and debris may slide rearwardly along and then off of said cantilever tines at said aft end tips without clogging at said aft end of said water intake.

10. The invention according to claim 9 wherein said aft end of said plate is curved downwardly along an arc below said cantilever tines, and wherein:

said plurality of cantilever tines each have a main undersurface extending rearwardly toward said aft end of said plate and a said tapered aft undersurface meeting said main undersurface at a junction and extending upwardly and rearwardly therefrom, such that each said junction is located progressively further aft from laterally outward tines to central tines such that said junction is located furthest aft in the most central tine and said junction is located furthest forward on the most laterally outward tines.

11. The invention according to claim 10 wherein:

said tapered aft undersurfaces of said plurality of cantilever tines extend upwardly and rearwardly to aft end tips, such that said aft end tips are located progressively further aft from the laterally outward tines to the central tines such that the aft end tip is located furthest aft in the most central tine and the aft end tip is located furthest forward on the most laterally outward tines.

12. The invention according to claim 11 wherein:

said aft end tips are spaced above and aft of said aft end of said plate.

13. The invention according to claim 12 wherein said aft end tips are substantially coplanar.

14. A marine jet drive weed grate for the water intake of a jet drive, said water intake having forward and aft ends and admitting water upwardly and rearwardly therein, said grate comprising:

a plate adapted to be mounted to said water intake and having a plurality of cantilever tines extending rearwardly toward said aft end of said water intake;

said cantilever tines having suspended aft end tips spaced from said aft end of said water intake such that weeds and debris may slide rearwardly along and then off of said cantilever tines at said aft end tips without clogging at said aft end of said water intake;

said cantilever tines having aft undersurfaces tapered upwardly and rearwardly to said aft end tips;

said tapered aft undersurfaces of said cantilever tines are spaced above said aft end of said water intake by a gap which extends upwardly and rearwardly;

said tapered aft undersurfaces being located progressively further forward from central tines to laterally outward tines, wherein the plurality of cantilevered tines comprise:

a pair of first cantilever tines located about the center of said plate, each tine having a first main undersurface extending rearwardly toward said aft end of said water intake, and a first tapered aft undersurface meeting said first main undersurface at a first junction and extending upwardly and rearwardly therefrom;

a pair of second cantilever tines each laterally outward of said first cantilever tines and each having a second main undersurface extending rearwardly toward said aft end of said water intake, and a second tapered aft undersurface meeting said second main undersurface at a second junction and extending upwardly and rearwardly therefrom;

a pair of third cantilever tines laterally outward of said second cantilever tines and having a third main undersurface extending rearwardly toward said aft end of said water intake, and a third tapered aft undersurface meeting said third main undersurface at a third junction and extending upwardly and rearwardly therefrom;

wherein said first junction is aft of said second junction;

and wherein said second junction is aft of said third junction.

15. The invention according to claim 14 wherein:

said first, second and third junctions are all coplanar in a first plane;

said first, second and third tapered undersurfaces extend upwardly and rearwardly from said first plane to respective first, second and third suspended aft end tips all coplanar in a second plane.

16. The invention according to claim 15 wherein:

said first and second planes are parallel;

said curved arcuate surface extends from said first plane upwardly and rearwardly to said second plane;

said curved arcuate surface intersects said first plane along a first arc;

said curved arcuate surface intersects said second plane along a second arc;

said first and second arcs are parallel.

* * * * *

UNITED STATES PATENT AND TRADEMARK OFFICE

CERTIFICATE OF CORRECTION

PATENT NO. : 5,577,941

DATED : November 26, 1996

INVENTOR(S) : BRIAN J. CHARTIER

It is certified that error appears in the above-identified patent and that said Letters Patent is hereby corrected as shown below:

Claim 5, column 4, lines 63-64, after "claim" insert —4—.

Signed and Sealed this

Sixth Day of May, 1997

*Attest:*

*Attesting Officer*

Bruce Lehman

BRUCE LEHMAN

*Commissioner of Patents and Trademarks*